US006714485B2

(12) United States Patent
Albisetti et al.

(10) Patent No.: US 6,714,485 B2
(45) Date of Patent: Mar. 30, 2004

(54) TIMEPIECE WITH ANALOGUE DISPLAY OF TIME RELATED INFORMATION BASED ON A DECIMAL SYSTEM

(75) Inventors: Carlo Albisetti, Courtelary (CH); Daniel Donzé , La Neuveville (CH); Clément Meyrat, Le Landeron (CH)

(73) Assignee: Swatch Group Mngmt Services AG (CH)

( * ) Notice: Subject to any disclaimer, the term of this patent is extended or adjusted under 35 U.S.C. 154(b) by 219 days.

(21) Appl. No.: 10/075,749

(22) Filed: Feb. 14, 2002

(65) Prior Publication Data

US 2002/0118606 A1 Aug. 29, 2002

(30) Foreign Application Priority Data

Feb. 23, 2001 (CH) ..... 0334/01

(51) Int. Cl.[7] ..... G04B 19/23; G04B 19/22

(52) U.S. Cl. ..... 368/27; 368/21; 368/80; 368/228; 368/295

(58) Field of Search ..... 368/21, 295, 228, 368/80, 27, 223, 300

(56) References Cited

U.S. PATENT DOCUMENTS 4,175,378 A * 11/1979 Shelton ..... 346/20
4,185,452 A * 1/1980 Ikeda ..... 368/76
5,023,850 A * 6/1991 Metts et al. ..... 368/28
5,444,674 A * 8/1995 Sellie ..... 368/107
6,579,004 B1 * 6/2003 Kim ..... 368/295

FOREIGN PATENT DOCUMENTS

CH 690 254 A5 6/2000

* cited by examiner

*Primary Examiner*—David Martin
*Assistant Examiner*—Jeanne-Marguerite Goodwin
(74) *Attorney, Agent, or Firm*—Richard K Robinson

(57) ABSTRACT

A timepiece is disclosed allowing a reading of a first conventional time information by means of first analogue display means including a dial (5) and hours (4*a*) and minutes (4*b*) indicator members driven by a movement of the timepiece, this timepiece including second analogue display means allowing a simultaneous reading of second time information based on a decimal system wherein time is divided at least into thousandths of a day. The second analogue display means include the dial and the minutes indicator member in addition to complementary analogue display means (4*a,* 7; 4*a,* 7*; 4*a,* 8; 4*c,* 9; 4*c,* 9*; 4*c,* 10; 11, 12) indicating at least approximate decimal values (71; 81; 91; 101; 111) of the full hours expressed in thousandths of a day. The minutes indicator member indicates on a dial, in addition to the minutes, corresponding decimal values (51; 51*a,* 51*b;* 51*a* to 51*d*) over a total duration of one hour, and the decimal time information is formed by adding the decimal value indicated on the dial by the minutes indicator member (4*b*) and the approximate decimal value indicated by the complementary analogue display means.

10 Claims, 8 Drawing Sheets

TIMEPIECE WITH ANALOGUE DISPLAY OF TIME RELATED INFORMATION BASED ON A DECIMAL SYSTEM

BACKGROUND OF THE INVENTION

The present invention relates to an analogue display timepiece allowing reading of first conventional time related information by means of hours and minutes indicator members, as well as simultaneous reading of second time related information based on a decimal system wherein time is divided into at least thousandths of a day.

An alternative system for measuring time has been recently proposed wherein the day is no longer divided into hours, minutes and seconds as is conventionally the case, but into thousandths of a day commonly called by the name "beat " and the duration of which is equivalent to 86.4 seconds. Twenty-four hours are thus divided into 1,000 thousandths of a day or "beats ", time evolving between the values of "000" and "999". This alternative system for measuring time is particularly intended for use by populations of internauts and for dispensing with notions of space and time zones. This time measuring system is also intended to be clearly distinguished from conventional time information.

A general object of the present invention is to propose an analogue display timepiece conventionally including a pair of hours and minutes indicator elements for displaying conventional time related information (for example the local time) and further allowing time related information based on the aforementioned decimal system to be read simultaneously.

More particularly, it is desired to propose a timepiece requiring a small number of modifications with respect to a conventional analogue display timepiece.

An analogue display timepiece including hours and minutes hands for the display of conventional time related information, and display means for second time information based on the aforementioned decimal system is already known from Swiss Patent No. 690 254. According to this document, the decimal time information is read by means of a single additional hand (preferably a hand completing one revolution per twenty-four hours) which rotates facing a scale of thousandths of a day arranged, for example, on an external bezel mounted on the timepiece, this external bezel preferably being rotatably mounted so as to allow adjustment of the decimal time information as a function of the time zone in which the user is located.

Apart from the thousandth of a day scale added to the external bezel, the timepiece disclosed in Swiss Patent No. 690 254 does not require any particular modification with respect to a conventional universal timepiece, such as the universal timepiece disclosed in Swiss Patent No. 451 827. This document in fact discloses a universal analogue display timepiece including hours and minutes hands, as well as an additional 24 hour hand rotating facing an external rotating bezel bearing the markings of the twenty-four time zones.

The timepiece of Swiss Patent No. 690 254 has a major drawback, particularly regarding its application to a wristwatch, in the sense that the user cannot obtain an accurate reading of the time based on the decimal system. Indeed, given the small size of a wristwatch, it is in practice impossible to add a high number of graduations to the bezel (or to the timepiece dial) in a legible manner. As can be seen in FIGS. 2 and 3 of Swiss document No. 690 254, graduation marks are made at the best every five thousandths of a day, i.e. for intervals of time equivalent to 432 seconds, namely a little more than seven minutes. Given the dimensions, one cannot in practice envisage making a higher number of graduation marks (in this case 200 marks). At this resolution, the time reading is random and may result in reading errors of several tens of minutes.

A more adequate solution allowing sufficiently accurate reading of the decimal time information must thus be found so that it can be used as a reference time for the purpose of fixing a meeting, for example, or the occurrence of an event.

SUMMARY OF THE INVENTION

In order to answer these objects, the present invention thus concerns an analogue display timepiece whose features are listed in independent claim 1.

Advantageous embodiments of the present invention form the subject of the dependent claims.

According to the invention, the time information based on the decimal system is obtained by the combined use of a minutes indicator member and complementary analogue display means indicating at least the approximate decimal value, expressed in thousandths of a day, of full hours (1h, 2h , . . . 23h, 24h), namely every 41 or 42 thousandths of a day (1 hour is equivalent to approximately 41.7 thousandths of a day) at least. According to the invention, the minutes indicator member indicates, on the one hand, the minute as is conventionally the case, and, on the other hand, a corresponding decimal value which is added to the approximate decimal value indicated by the complementary analogue display means. Despite the approximation of the full hours (the error of approximation never exceeds a thousandth of a day), the minutes indicator member and the additional display member provide the user with sufficiently accurate time information for him to be able to rely on this decimal time information for the purpose of fixing a meeting in particular.

Preferably, the approximate decimal values are borne by a display member which can be adjusted in rotation, independently of the hours and minutes indicator members, in order to allow correction of the decimal time information as a function of the time zone in which the user is located.

Generally, two preferred embodiment principles of the present invention may be distinguished. According to a first embodiment principle, the decimal time information is indicated by the minutes and hours indicator members used for reading the conventional time information. The complementary analogue display means then rely on an additional display member which can be adjusted in rotation on which at least the indications of the approximate decimal values of the full hours are shown (cf. FIGS. 1 to 3, and 8).

According to a second preferred embodiment principle, the decimal time information is indicated by the minutes indicator member and by another additional member driven by the movement different from the hours indicator member. Two alternative embodiments of this second principle are described. One consists in using an additional indicator member driven by the movement, this indicator member being associated with a display member which can preferably be adjusted in rotation and on which at least the approximate decimal values of the full hours are shown (cf. FIGS. 4 to 6). The other alternative consists in directly driving, via the movement, the display member on which the indications of the approximate decimal values are shown, the indicator member being replaced in this case by a fixed index added to the timepiece (cf. FIG. 7).

The two aforementioned embodiment principles have in particular, as common features, the fact that the minutes indicator member and the complementary analogue display means together allow accurate reading of the time information based on the aforementioned decimal system.

Other features and advantages of the present invention will appear more clearly upon reading the following detailed description, made with reference to the annexed drawings given by way of non-limiting examples and in which:

DETAILED DESCRIPTION OF THE INVENTION

Figure 1:
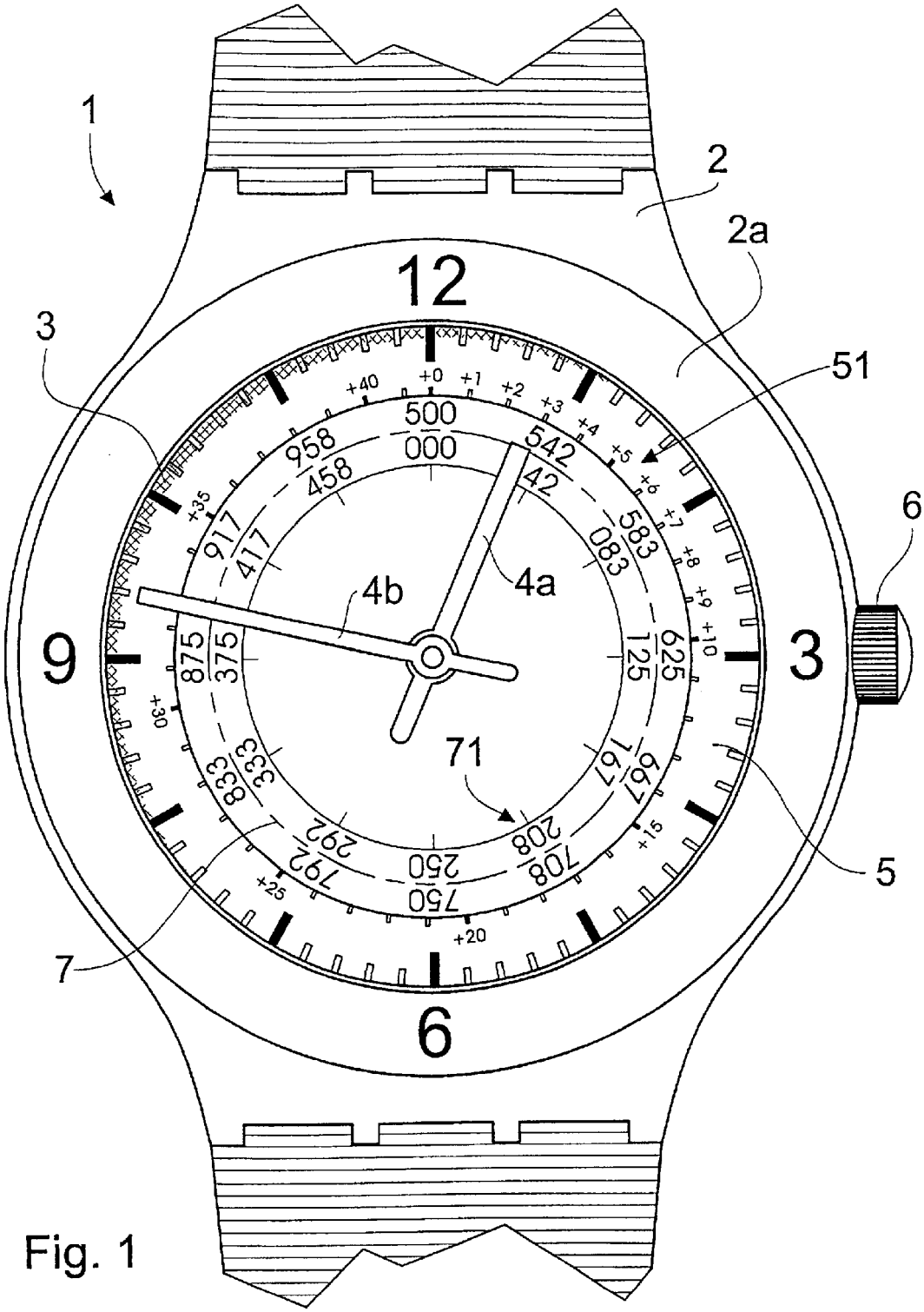
FIGS. 1 to 3 show respectively first, second and third embodiments of the present invention answering the aforementioned first embodiment principle relying in particular on the minutes and hours indicator members which already exist to obtain the decimal time information.

FIG. 1 shows a first embodiment of a timepiece according to the invention. In this example, the timepiece takes the form of an analogue display wristwatch generally indicated by the reference numeral 1. This wristwatch 1 includes in particular and typically a case-middle part 2 enclosing a movement (not shown), a bezel 2*a*, a crystal 3, first analogue display means including a dial 5 and first and second hours and minutes indicator members 4*a*, 4*b* driven by the movement (here a pair of hours and minutes hands), and a time-setting crown 6. The movement used in the timepiece illustrated is a conventional 12-hour movement, i.e. the hours indicator member makes one complete revolution in twelve hours. It will be understood however that the invention is also applicable to a timepiece including a 24-hour movement in which the indicator member makes a complete revolution in twenty-four hours.

According to the present invention, the timepiece further includes second analogue display means allowing simultaneous reading of time information based on a decimal system wherein the time is divided at least into thousandths of a day. As mentioned in the preamble, according to this decimal system, the time is formed of a three figure number varying between "000" and "999", "000" corresponding to midnight, winter time, at the meridian passing through the town of Bienne in Switzerland, hereinafter called BMT (Biel Mean Time) by analogy with the abbreviation GMT, Greenwich Mean Time.

According to the invention, the second analogue display means share in particular dial 5 and minutes indicator member 4*b* with the first analogue display means. This minutes indicator member 4*b* is used together with complementary analogue display means forming the remaining part of the second display means allowing the decimal time information to be formed.

As mentioned in the preamble, according to a first embodiment principle of the invention illustrated in particular by this first embodiment, the complementary analogue display means include the hours indicator member 4*a* and an additional display member which can be adjusted in rotation, indicated by the reference numeral 7, formed in this example by an indicator disc similar to a day disc which is mounted concentric to indicator members 4*a*, 4*b*. Unlike a day disc, this display member 7 is however not driven in rotation by the movement and is subdivided into a different number of angular sectors. The angular position of this display member 7 is simply adjusted by means of time-setting crown 6. The mechanism used to allow this adjustment in rotation is similar to a conventional mechanism allowing the day to be corrected, which is known to those skilled in the art and will consequently not be described here.

Dial 5 commonly bears a plurality of indicia regularly distributed over its periphery and providing hour and minute indications. In addition to these indications, the dial also bears corresponding decimal values 51 over a total duration of sixty minutes. Expressed in thousandths of a day, sixty minutes is equivalent to approximately 41.7 thousandths of a day. In this example, the dial is thus graduated every thousandth of a day from "0" to "41" facing the minute graduations.

Display member 7 is regularly subdivided into twelve angular sectors each bearing first and second approximate decimal values 71 corresponding to the full hours. Midnight BMT is thus indicated by the decimal value "000", 1 o'clock BMT by the approximate decimal value"042", 2 o'clock by the approximate decimal value "083", etc. up to 23 hours BMT which is indicated by the approximate decimal value "958". Given that, in this example, hours indicator member 4*a* is used to deduce the decimal time information, this hours indicator member making one revolution every twelve hours in this example, display member 7 bears, in each angular sector, a pair of decimal values separated from each other by twelve hours, i.e. 500 thousandths of a day.

In the example illustrated in FIG. 1, display member 7 is adjusted for the time zone including the Biel meridian, i.e. the pair of decimal values "000–500" is positioned at midday. A user located in New York (-6 hours with respect to the town of Biel) will have to position display member 7 so that the pair of decimal values "000–500" is situated at 6 o'clock. A user located in Moscow (+2 hours with respect to the town of Biel) will have to position display member 7 so that the pair of decimal values "000–500" is situated at 2 o'clock.

According to this first embodiment principle, the time information based on the aforementioned decimal system is formed by adding the decimal values indicated respectively by minutes indicator member 4*b* and hours indicator member 4*a*. In the present case, the time indicated is 12h47 (PM). The decimal value indicated on dial 5 by minutes indicator member 4*b* is thus a little more than 32 thousandths of a day and the approximate decimal value indicated on display member 7 by hours indicator member 4*a* is "500". The total decimal value obtained by adding is approximately 532 thousandths of a day, which corresponds to the equivalent, expressed in thousandths of a day, of 12h47 BMT.

Figure 2:
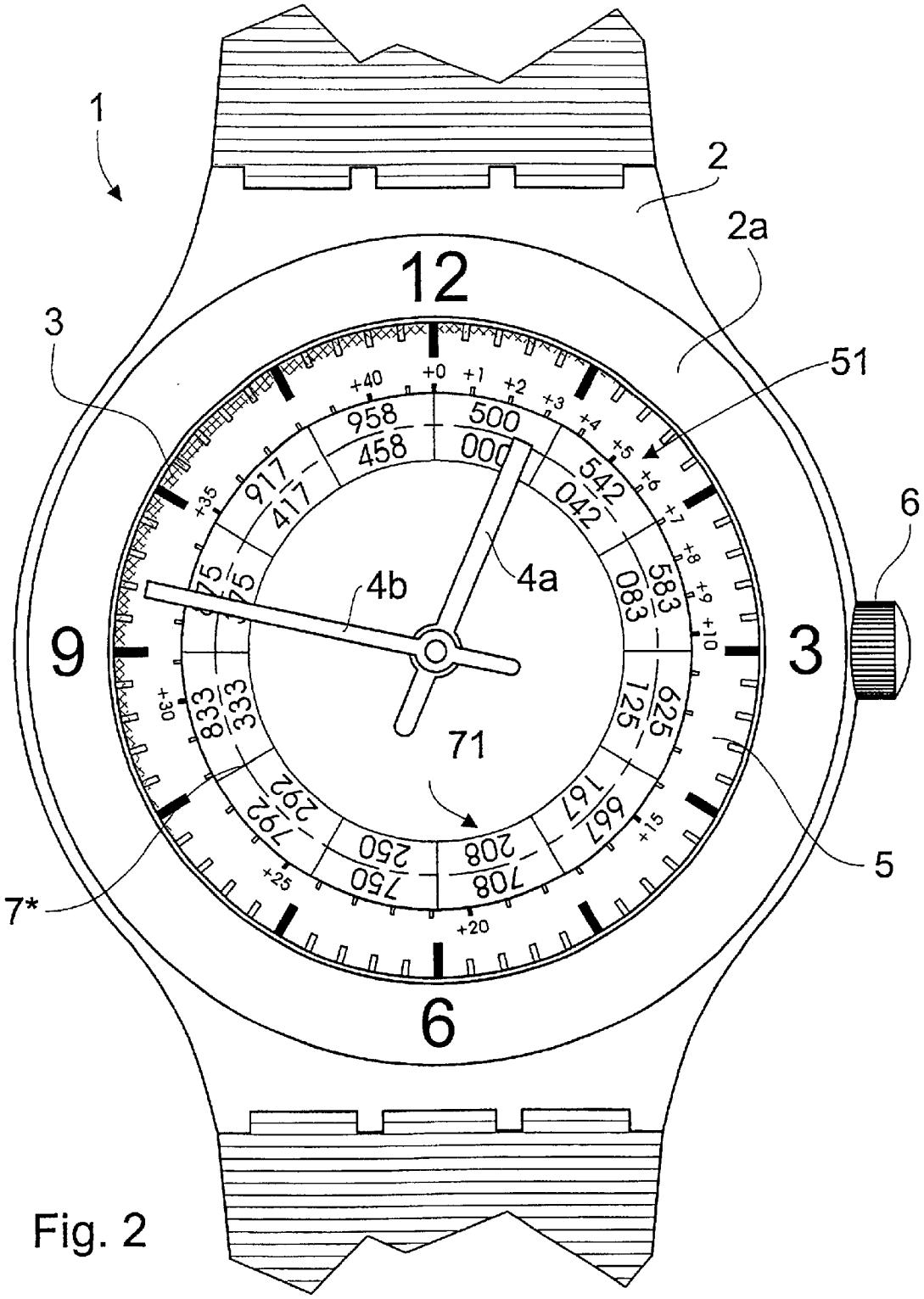

FIG. 2 shows a second embodiment of the invention constituting a variant of the first embodiment of FIG. 1. The difference lies here in the angular arrangement of the indications of the approximate decimal values 71 on the display member, here indicated by the reference numeral 7*. Compared to the example illustrated in FIG. 1, the approximate decimal values 71 are offset angularly by 15° to the right so that hours indicator member 4*a* always points to a determined sector, here the angular sector including the pair of decimal values "000–500".

Figure 3:
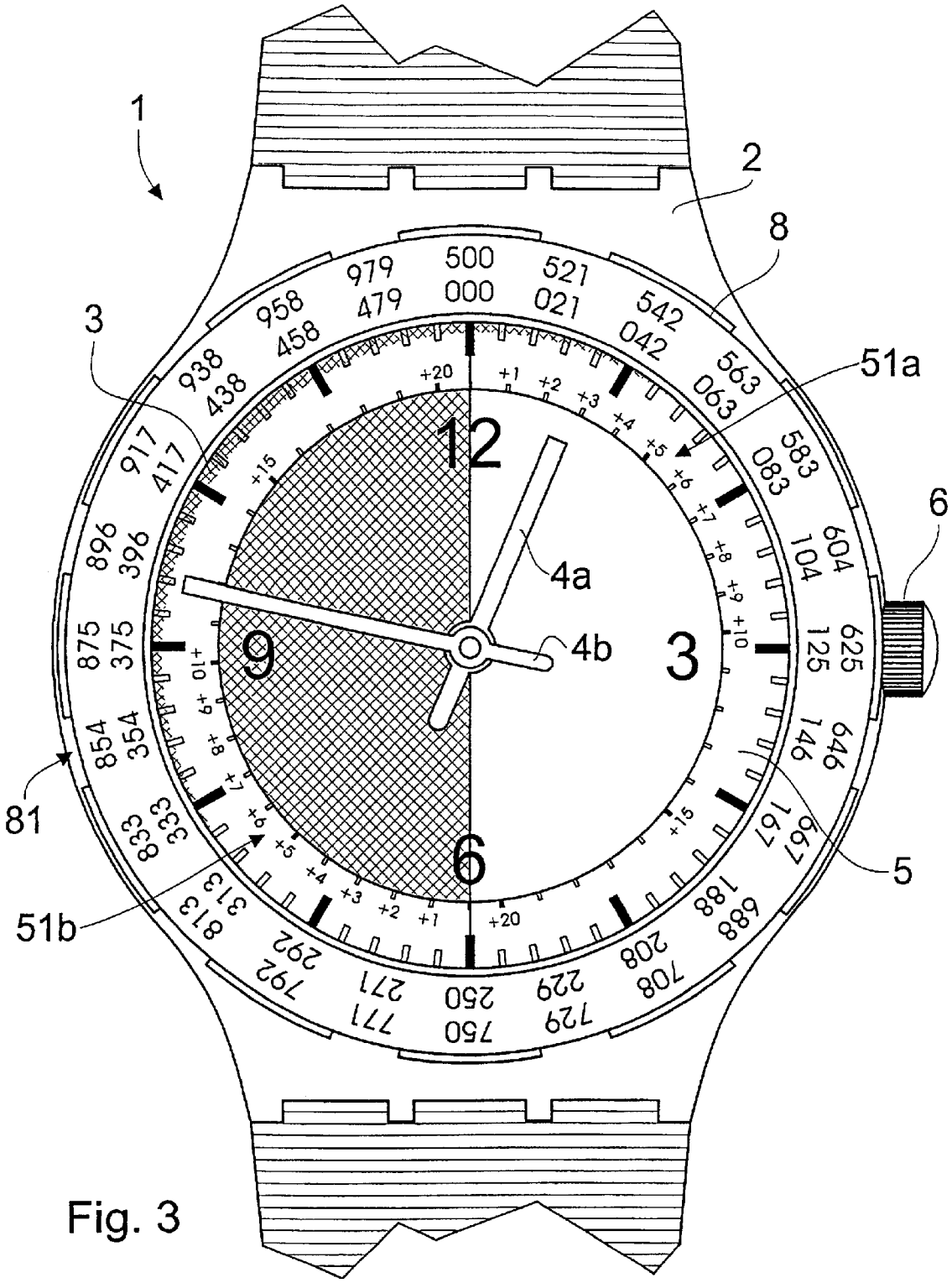

It should be mentioned that the indicator disc used in the embodiments of FIGS. 1 and 2 may be replaced by any other indicator member which can be adjusted in rotation, such as a rotating external bezel for example, as shown in FIG. 3.

It should also be mentioned that the subdivisions of the display member 7, 7* illustrated in the first and second embodiments of FIGS. 1 and 2 are not in any way limiting. In fact the display member could alternatively be subdivided into 2×12, 3×12, 4×12 angular sectors or more, i.e. with time intervals of 30, 20 or 15 minutes between the various approximate decimal values indicated on the display member. It will be noted in particular that a subdivision every 30 or 15 minutes will advantageously allow account to be taken of the existence of time zones whose time difference is not a whole multiple of an hour.

Generally, the display member (7, 7* in the FIGS. 1 and 2 respectively) can be subdivided into N×12 regular angular sectors, N being an integer number, the approximate decimal values being indicated successively in each angular sector of the display member, in ascending order and in the clockwise direction, with time intervals equivalent to 60/N minutes. Dial 5 is likewise subdivided into N equal angular sectors each indicating the corresponding decimal values of the minutes over a duration of 60/N minutes for each angular sector.

Given the typical dimensions of a timepiece and constraints in terms of the legibility of the markings on the dial and on the display member, the number of subdivisions able to be made is limited. Thus, 48 (N=4) or 96 (N=5) typically constitute the maximum number of subdivisions which can be possibly envisaged on the display member.

FIG. 3 shows a third embodiment of the invention relying on a similar embodiment principle to the principle used for the embodiments of FIGS. 1 and 2. One difference lies in particular in the fact that the display member which can be adjusted in rotation, in the form of an indicator disc in FIGS. 1 and 2, is formed in this example by a rotating external bezel generally indicated by the reference numeral 8. Another difference lies in the fact that this rotating bezel 8 is subdivided into 2×12=24 regular angular sectors (N=2) and in that the approximate decimal values, referenced 81, are successively indicated in each angular sector with time intervals equivalent to 60/2=30 minutes approximately, namely every 20 or 21 thousandths of a day. The approximate decimal values indicated are thus successively, in the clockwise direction, "000", "021", "042", "063", . . . , "938", "958", "979". Dial 5 is thus also subdivided into two angular sectors each including a scale from "0" to "20", one referenced 51*a*, extending from 12 o'clock, and the other, referenced 51*b*, extending from 6 o'clock in the clockwise direction.

In the case illustrated, the hours and minutes indicator members 4*a* and 4*b* indicate respectively the decimal values "521" and "11" approximately, namely 532 thousandths of a day after addition.

Within the scope of the embodiments of FIGS. 1 to 3, it may to useful to add an AM/PM indicator mechanism distinguishing which of the two approximate decimal values marked on the display member (7, 7* or 8 in the Figures) has to be considered at a given moment. In the embodiments of FIGS. 1 to 3, it will have been noted that the first and second approximate decimal values marked on the complementary display member are arranged on two distinct circles, one outer and the other inner. The approximate decimal values marked on the inner circle correspond to the morning (AM) at the Biel meridian and the decimal values marked on the outer circle correspond to the afternoon (PM) at the Biel meridian. In order to distinguish which of the two decimal values must be considered at a given moment, an AM/PM indicator mechanism well known to those skilled in the art, set to Biel, could thus be used. Such a mechanism could for example include an indicator member making one revolution per twenty-four hours rotating facing an AM/PM subdivision (or alternatively 0/+500).

As already mentioned, it will be understood that one could also apply the principle described hereinbefore to a 24-hour movement, i.e. a movement whose hour indicator member makes one complete revolution in twenty-four hours, in which case it will no longer be necessary to use an additional AM/PM indicator mechanism to distinguish which of the two decimal values marked in the angular sector being considered has to be taken into account at a given moment, each angular sector of the rotatably adjustable display member including in fact only one marked decimal value.

Figure 8:
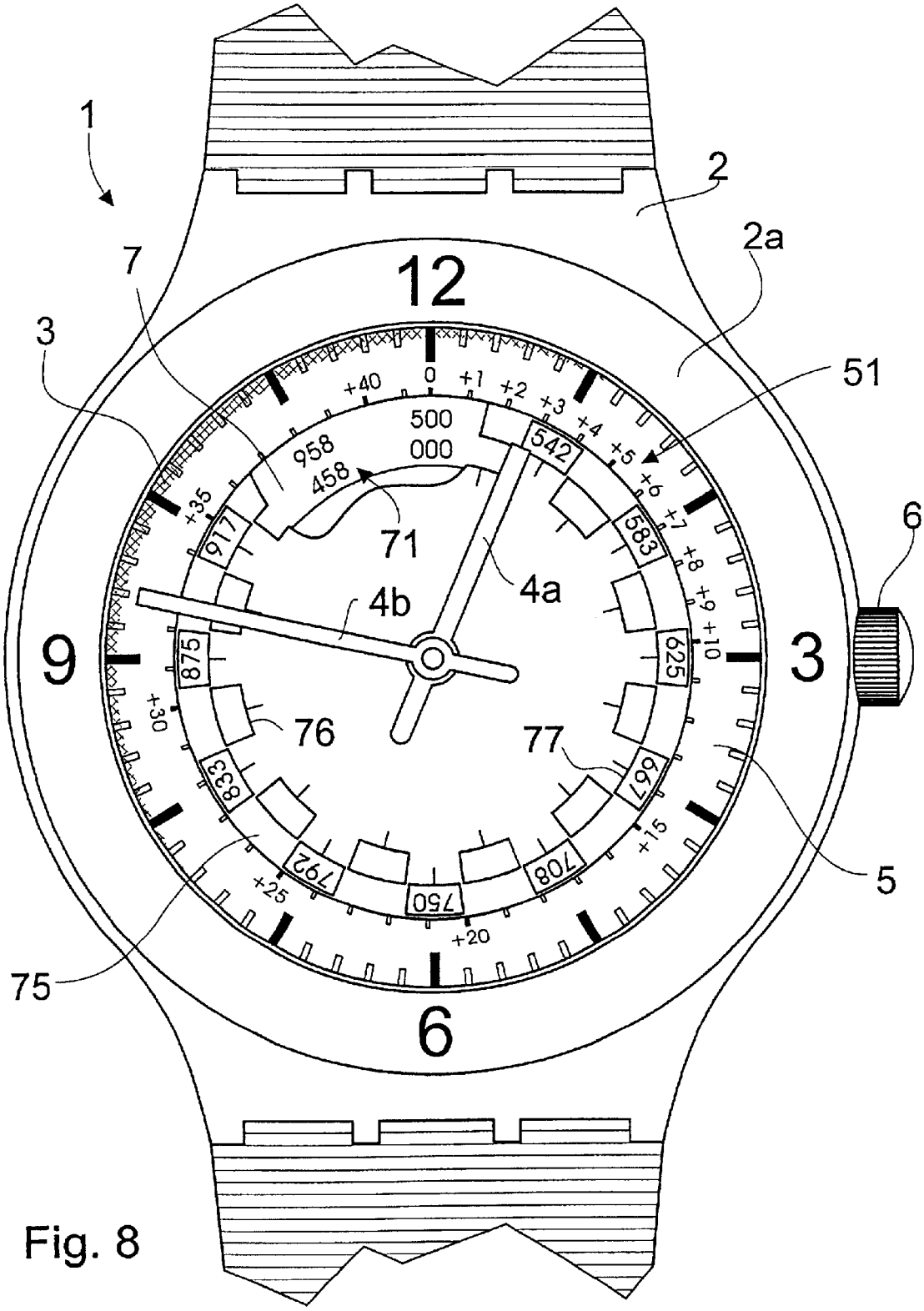
FIG. 8 is an advantageous variant of the first embodiment illustrated in FIG. 1 including an additional mechanism allowing approximate decimal values indicated on the additional display member to be alternately masked every twelve hours.

Advantageously, a mechanism could be added to the timepiece allowing the first or second approximate decimal values indicated on the rotatably adjustable display member to be alternately masked every twelve hours. FIG. 8 shows an illustration of such a mechanism applied to the first embodiment illustrated in FIG. 1. In addition to the elements already presented with reference to FIG. 1 (designated by the same reference numerals in FIG. 8), the timepiece includes a disc 75 superposed on display member 7 bearing the indications of approximate decimal values 71 of the full hours. A part of disc 75 has not been shown to allow display member 7 to be seen.

This disc 75 is provided with a first series of openings 76 (twelve in number here) through which the first approximate decimal values can appear, for a given angular position of disc 75, indicated in the various angular sectors of display member 7 (here the values "000" to "458"). Disc 75 is provided with a second series of openings 77 (also twelve in number) offset angularly (by 15° in this example) with respect to the first series of openings 76 and through which the second approximate decimal values, indicated in the angular sectors of display member 7 (here the values "500" to "958") can appear for another given angular position of disc 75. In the example of FIG. 8, the second series of openings 77 allows the second decimal values "500" to "958" to appear, whereas the first series of openings 76 is offset with respect to the indications first approximate decimal values "000" to "458".

Disc 75 is driven so that it makes, every twelve hours, a rotation of one angular step alternately bringing the first series of openings 76 and the second series of openings 77 respectively above first and second approximate decimal values 71. In this example, a complete revolution of disc 75 is made in twelve days, i.e. in twenty-four angular steps of 15° each. It will thus be understood that disc 75 allows the first or second approximate decimal values 71 indicated on the rotatably adjustable display member 7 to be masked alternately every twelve hours. Thus, twelve hours later, i.e. at 0h47, disc 75 will be offset angularly by 15° and will only allow the approximate decimal values "000" to "458" to appear. The decimal time information obtained by addition would thus equal 32 thousandths of a day.

According to a second embodiment principle of the invention which will now be described with reference to FIGS. 4 to 7, the complementary analogue display means rely not on hours indicator member 4*a* but on an additional member driven by the movement.

Figure 4:
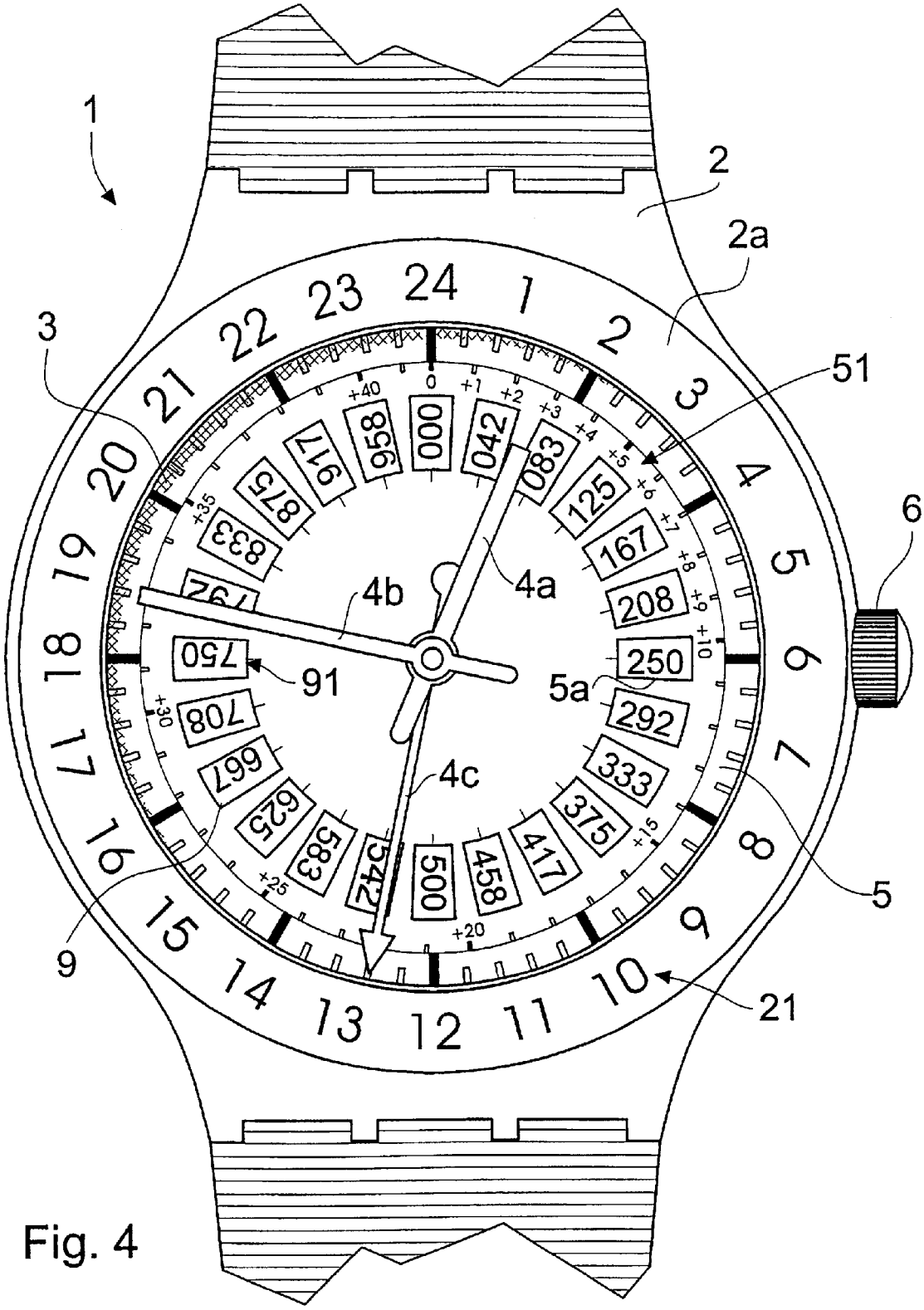
FIGS. 4 to 7 show respectively fourth, fifth, sixth and seventh embodiments of the present invention answering the second embodiment principle relying in particular on the minutes indicator member and an additional indicator member driven by the movement to obtain the decimal time information.

FIG. 4 thus shows a fourth embodiment of the invention answering this second embodiment principle. The timepiece illustrated in this Figure includes, in accordance with what was already mentioned hereinbefore, a case-middle part 2, a crystal 3, hours and minutes indicator members 4*a*, 4*b*, a dial 5 and a time-setting crown 6. This timepiece further includes an additional indicator member 4*c* driven by the movement (here in the form of a hand) making one revolution every twenty-four hours and an additional display member 9 mounted concentric to the hours and minutes indicator members 4*a* and 4*b* below dial 5. This additional display member 9 bears markings, referenced 91, of the approximate decimal values of the full hours expressed in thousandths of a day. These markings 91 are visible through a plurality of apertures 5*a*, twenty-four in number in this example, arranged in dial 5.

Generally, according to this second embodiment principle, the display member bearing the decimal value indications can be subdivided into N×24 regular angular sectors, N being an integer number as previously, the approximate decimal values being successively indicated in each angular sector of the indicator member, in ascending order and in the clockwise direction, with time intervals equivalent to 60/N minutes. Dial 5 is likewise subdivided into N equal angular sectors each indicating the corresponding decimal values of the minutes over a duration of 60/N minutes for each angular sector.

In the embodiment illustrated in FIG. 4, N is equivalent to 1 and display member 9 bearing the markings of the approximate decimal values is thus subdivided into twenty-four equal angular sectors, dial 5 including only one sector bearing the corresponding decimal values 51 over a total duration of sixty minutes, namely from "0" to "41" thousandths of a day.

In a similar way to that described previously, the decimal time information is formed by adding the decimal values indicated by the additional display member 9 and indicator member 4*c*, on the one hand, and minutes indicator member 4*b* and dial 5, on the other hand, in this example again "500" and "32", namely 532 thousandths of a day after addition.

It will be understood that it is not necessary for additional indicator member 4*c* to be adjustable independently of the minute and hour indicator members, provided that display member 9 bearing the approximate decimal values 91 is adjustable in rotation. One may however perfectly well decide not to use a display member which is adjustable in rotation and make the approximate decimal value markings directly on the dial (or on a bezel of the timepiece) in which case it is then necessary for additional indicator member 4*c* to be adjustable independently of the minutes and hours indicator members.

The solution consisting in marking the approximate decimal values on a rotatably adjustable display member has, however, certain advantages. Indeed, as illustrated in FIG. 4, by applying markings, referenced 21, of the twenty-four hours (1, 2*h*, . . . . 24*h*) facing the various positions of approximate decimal values 91 marked on display member 9 (in this case on bezel 2*a* of the timepiece), the user has available a simple and direct correspondence between the conventional and decimal time information. In particular, the user may obtain an approximate conversion between the conventional duodecimal system and the decimal system. Indeed, assuming that the user agrees on a meeting or schedules an event for "300", he will easily be able to see that this corresponds approximately to 7 o'clock in the morning, local time, in this example.

Figure 5:
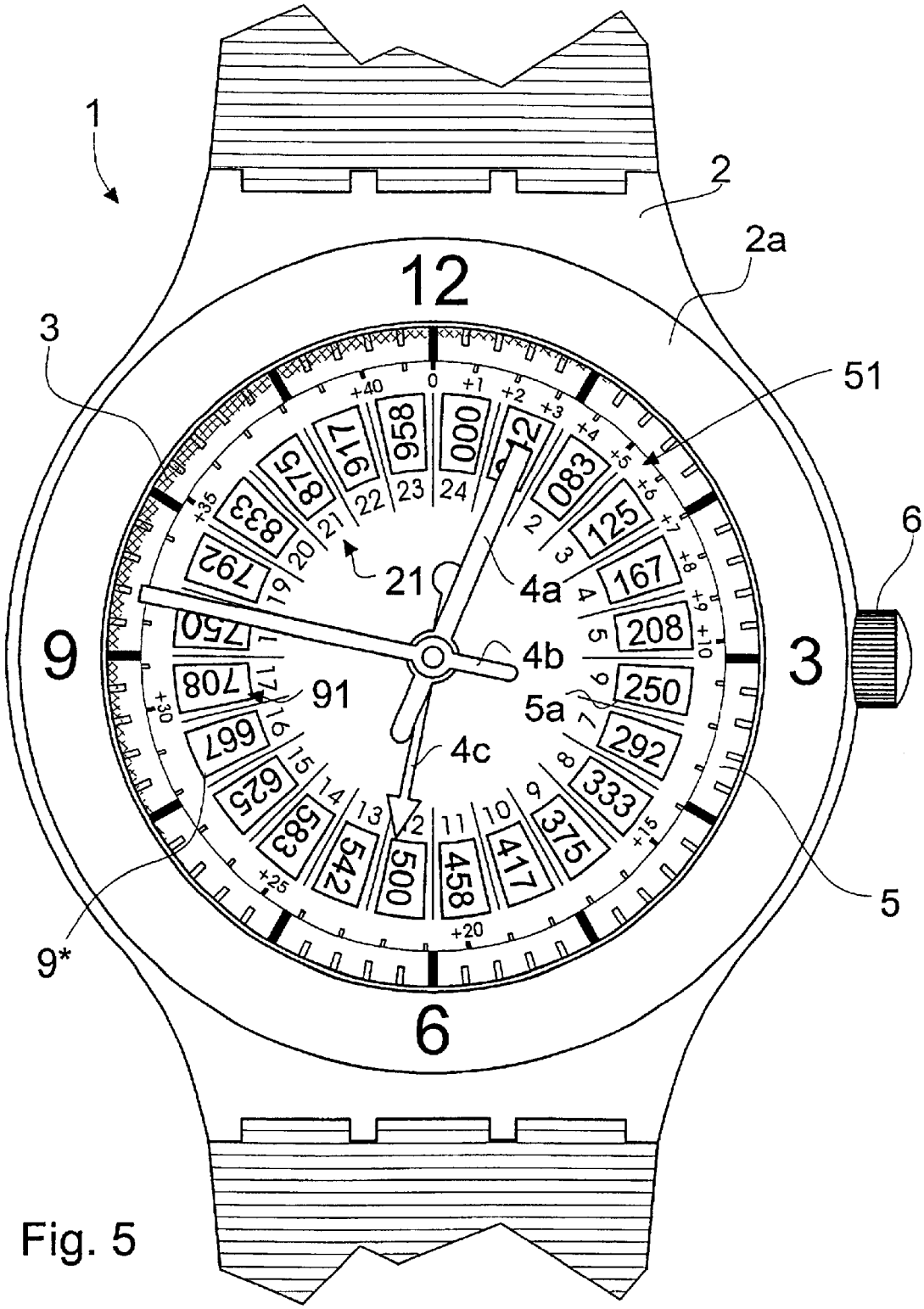

FIG. 5 shows a fifth embodiment of the invention constituting a variant of the fourth embodiment of FIG. 4. One difference lies here in the angular arrangement of the indications of approximate decimal values 91 on the display member, here indicated by the reference numeral 9*. Compared to the example illustrated in FIG. 4, the decimal values are offset angularly by 7.5° towards the right so that the additional indicator member 4*c* always points into a determined sector, here the angular sector comprising a decimal value "500".

Another difference with respect to the embodiment of FIG. 4 lies in the fact that the markings 21 of the twenty-four hours "1" to "24" are added to dial 5 and no longer to bezel 2*a*.

Figure 6:
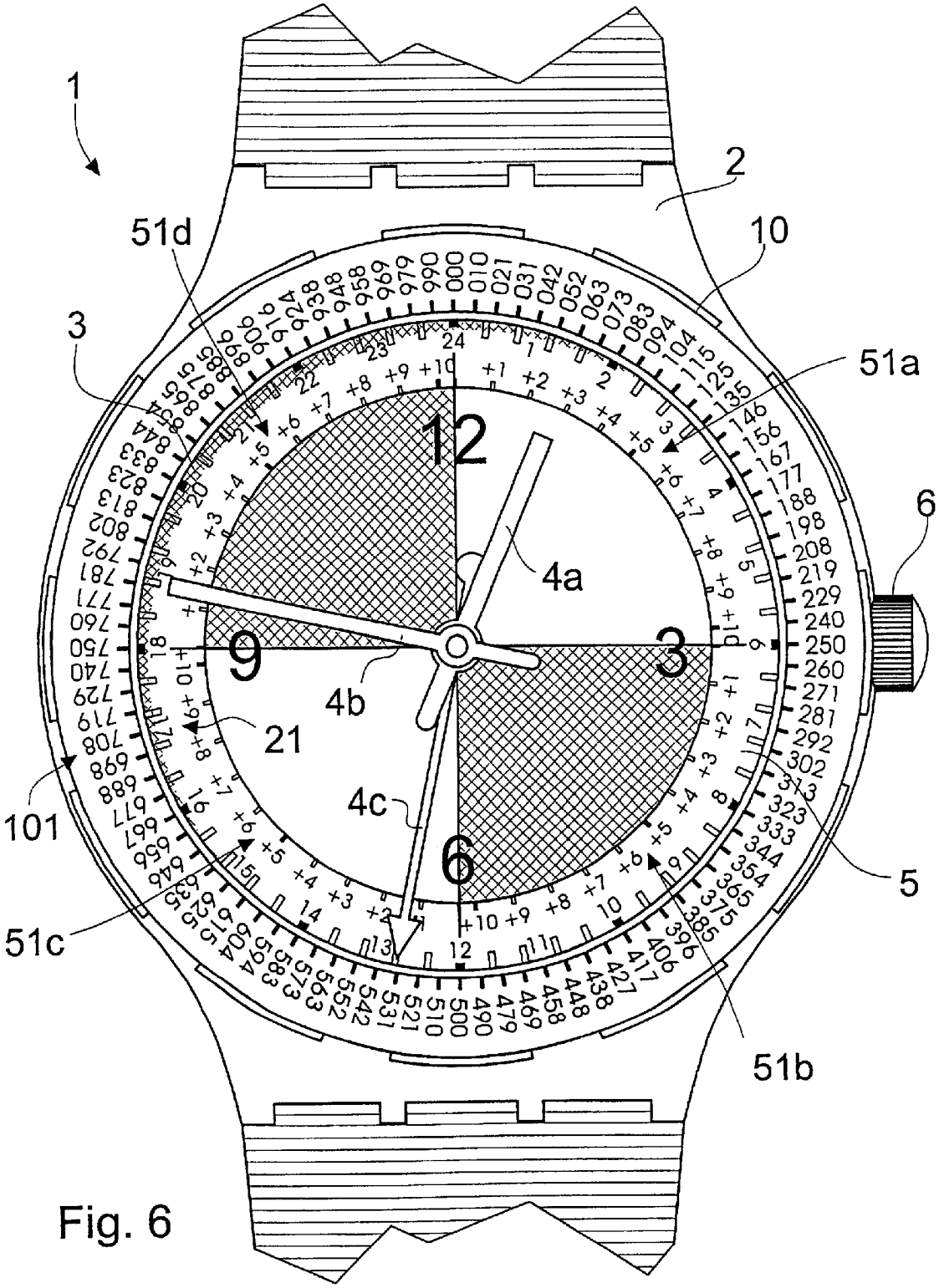

FIG. 6 shows a sixth embodiment of the invention relying on a similar embodiment principle to the principle used for the embodiments of FIGS. 4 and 5. A difference lies in particular in the fact that the rotatably adjustable display member, in the form of an indicator disc in FIGS. 4 and 5, is formed in this example of a rotating external bezel generally indicated by the reference numeral 10. Another difference lies in the fact that this rotating bezel 10 is subdivided into 4×24=96 regular angular sectors (N=4) and in that the approximate decimal values, designated 101, are indicated successively in each angular sector with time intervals equivalent to 60/4=15 minutes approximately, namely every 10 or 11 thousandths of a day. The approximate decimal values indicated are thus successively, in the clockwise direction, "000", "010", "021", "031", . . . , "969", "979", "990". Dial 5 is thus also subdivided into being indicated respectively by the reference numerals 51*a* to 51*d* in FIG. 6. The markings 21 of the twenty-four hours are also added to the periphery of dial 5.

In the case illustrated, additional indicator member 4*c* and minutes indicator member 4*b* respectively indicate the decimal values "531" and "1", namely 532 thousandths of a day after addition.

It will be recalled again that the number of subdivisions may be different. For example, in order to ease the legibility of the timepiece a little, one could choose a division every 20 minutes (N=3) and thus subdivide rotating bezel 10 and dial 5 into respectively 72 and 3 regular angular sectors.

Figure 7:
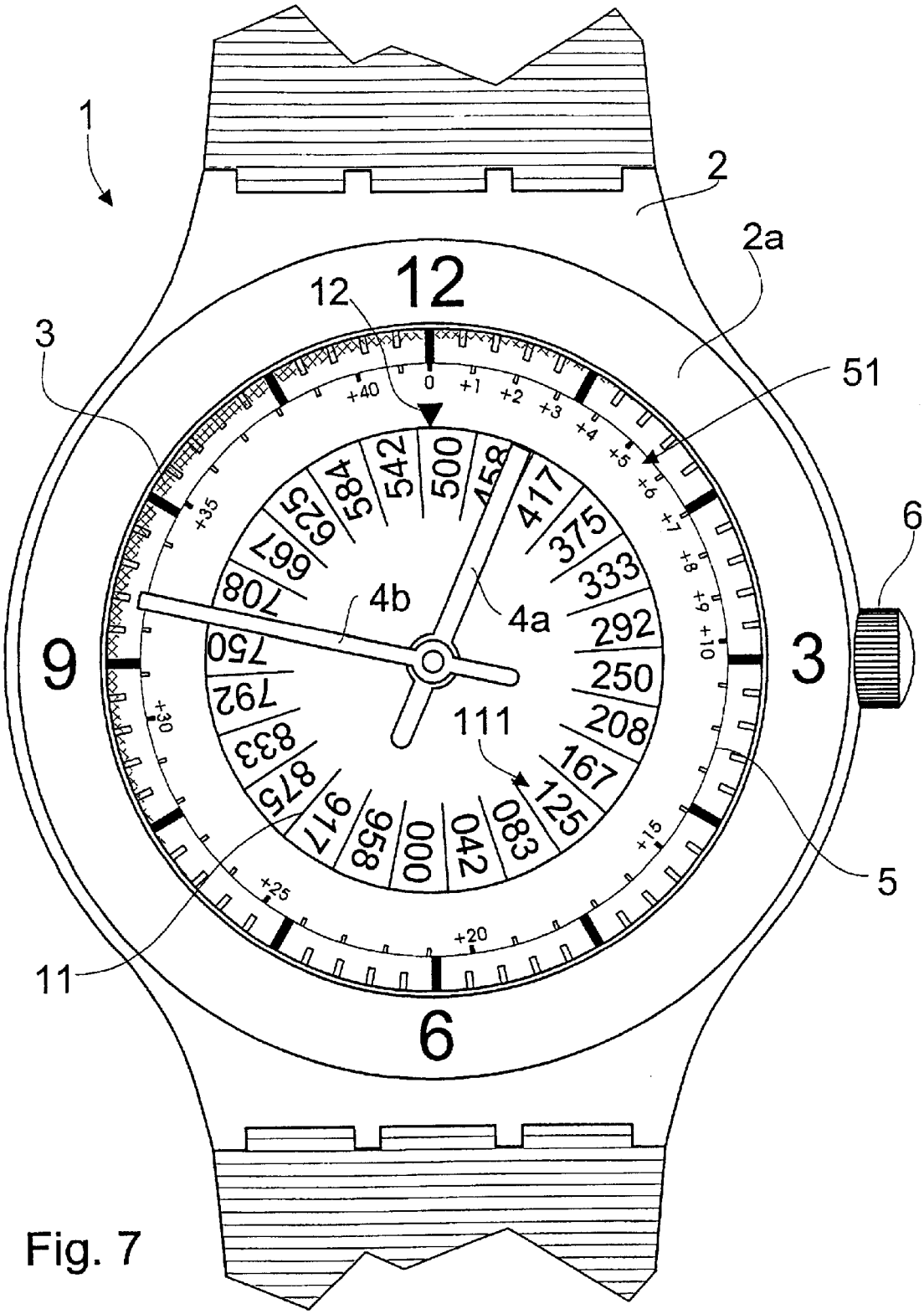

FIG. 7 shows a seventh embodiment of the invention also answering the aforementioned second embodiment principle. Unlike the embodiments of FIGS. 4 to 6, the complementary analogue display means include a fixed index 12 associated with an additional display member driven by the movement, indicated by the reference numeral 11, and bearing the indications of approximate decimal values 11 of the full hours. Additional display member 11 has the shape of a disc similar to the indicator disc (which is not driven) of the embodiments of FIGS. 1, 2, 4 or 5, with the only difference that the latter is driven by the movement to make a complete revolution in twenty-four hours (in the clockwise direction in this example), the markings of approximate decimal values 111 being arranged in ascending order and in the anticlockwise direction because of the rotational direction of display member 11. It will be understood that the rotational direction of display member 11 can be reversed, i.e. the member may be driven in the anticlockwise direction via the use of an additional intermediate wheel, in which case the markings of approximate decimal values 111 would have to be arranged in the clockwise direction.

Fixed index 12 is arranged, in this example, at 12 o'clock on dial 5 and indicates the decimal value having to be considered on additional display member 11. It will of course be understood that this index 12 may be added at a different position or on another part of the timepiece, such as bezel 2*a*.

The angular position of display member 11 is adjusted in a conventional manner by means of time-setting crown 6. Preferably, a correction mechanism well known to those skilled in the art will be used allowing correction by one hour steps in this example (or by steps of 15, 20 or 30 minutes if another subdivision is adopted).

It will be understood that various modifications and/or improvements obvious to those skilled in the art may be made to the various embodiments described in the present description without departing from the scope of the invention defined by the annexed claims. In particular, it will be understood that the hour and minute indicator members may be made in the form of indicator members other than hands, such as a rotating disc bearing an index for example. It will be understood generally that any analogue display which gives, by definition, a time indication via the relative movement of a mark and a scale (typically a hand and a dial as illustrated in the various Figures) could be used to obtain the desired result.

It will also be understood that the present invention is also applicable to a 24 hour movement where the hour indicator member makes one complete revolution in twenty-four hours.

The present invention is of course also applicable to timepieces other than wristwatches, such as a table clock or a wall clock, for example.

What is claimed is:

1. A timepiece allowing a reading of first conventional time information by means of first analogue display means including a dial and hours and minutes indicator members driven by a movement of the timepiece, this timepiece including second analogue display means allowing a simultaneous reading of second time information based on a decimal system wherein time is divided at least into thousandths of a day, wherein said second analogue display means include said dial and said minutes indicator member in addition to complementary analogue display means indicating at least approximate decimal values of the full hours expressed in thousandths of a day, said minutes indicator member indicating on said dial, in addition to the minutes, corresponding decimal values over a total duration of one hour, said second time information based on the decimal system being formed by adding the decimal value indicated on said dial by said minutes indicator member and the approximate decimal value indicated by said complementary analogue display means.

2. The timepiece according to claim 1, wherein said complementary analogue display means include said hours indicator member associated with a rotatably adjustable display member mounted on the timepiece and on which at least said approximate decimal values of the full hours are indicated.

3. The timepiece according to claim 2, wherein said hours indicator member makes one complete revolution in twelve hours and in that said rotatably adjustable display member is subdivided into 12×N equal angular sectors, N being an integer number, each angular sector including indications of first and second approximate decimal values separated from each other by twelve hours, these first and second approximate decimal values being indicated successively in each angular sector, in ascending order and in the clockwise direction, with time intervals equivalent to 60/N minutes, said dial being subdivided into N equal angular sectors each indicating the corresponding decimal values of the minutes over a duration of 60/N minutes for each angular sector.

4. The timepiece according to claim 3, further including an AM/PM indicator mechanism allowing which of said first and second approximate decimal values has to be considered at a given moment.

5. The timepiece according to claim 3, further including a mechanism allowing said first or second approximate decimal values, indicated on said rotatably adjustable display member, to be masked alternately every twelve hours.

6. The timepiece according to claim 1, wherein said complementary analogue display means include an indicator member driven by said movement and making a complete revolution in twenty-four hours associated with a rotatably adjustable display member mounted on the timepiece and on which at least said approximate decimal values of the full hours are indicated.

7. The timepiece according to claim 6, characterised in that said rotatably adjustable display member is subdivided into 24×N equal angular sectors, N being an integer number, each angular sector including an indication of an approximate decimal value, this approximate decimal value being indicated successively in each angular sector, in ascending order and in the clockwise direction, with time intervals equivalent to 60/N minutes, said dial being subdivided into N equal angular sectors each indicating the corresponding decimal values of the minutes over a duration of 60/N minutes for each angular sector.

8. The timepiece according to claim 6, further including an indication of the twenty-four hours facing the corresponding approximate decimal values indicated on said rotatably adjustable display member.

9. The timepiece according to claim 1, wherein said complementary analogue display means include a fixed index associated with a display member driven by said movement on which at least said approximate decimal values of the full hours are indicated.

10. The timepiece according to claim 9, wherein said driven display member makes a complete revolution in twenty-four hours and is subdivided into 24×N equal angular sectors, N being an integer number, each angular sector including an indication of an approximate decimal value, this approximate decimal value being successively indicated in each angular sector, in ascending order, with time intervals equivalent to 60/N minutes, said dial being subdivided into N equal angular sectors each indicating the corresponding decimal values of the minutes over a duration of 60/N minutes for each angular sector.

* * * * *